US009644478B2

(12) United States Patent
Corre et al.

(10) Patent No.: US 9,644,478 B2
(45) Date of Patent: May 9, 2017

(54) SAMPLING ASSEMBLY FOR A SINGLE PACKER

(75) Inventors: Pierre-Yves Corre, Eu (FR); Stephane Metayer, Abbeville (FR); Alexander F. Zazovsky, Houston, TX (US); Stephen Yeldell, Sugar Land, TX (US); Darya Mustafina, Korolev (RU)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 901 days.

(21) Appl. No.: 13/996,486

(22) PCT Filed: Dec. 20, 2011

(86) PCT No.: PCT/US2011/066070

§ 371 (c)(1),
(2), (4) Date: Oct. 8, 2013

(87) PCT Pub. No.: WO2012/088058

PCT Pub. Date: Jun. 28, 2012

(65) Prior Publication Data

US 2014/0020890 A1 Jan. 23, 2014

Related U.S. Application Data

(60) Provisional application No. 61/424,991, filed on Dec. 20, 2010.

(51) Int. Cl.
*E21B 49/08* (2006.01)
*E21B 33/12* (2006.01)

(52) U.S. Cl.
CPC ..... *E21B 49/08* (2013.01); *E21B 33/1208* (2013.01); *E21B 49/081* (2013.01)

(58) Field of Classification Search
CPC ..... E21B 49/08; E21B 49/081; E21B 33/1208
See application file for complete search history.

(56) References Cited

U.S. PATENT DOCUMENTS

| | | | |
|---|---|---|---|
| 7,699,124 | B2 | 4/2010 | Corre et al. |
| 2008/0125973 | A1 | 5/2008 | Sherwood et al. |
| 2008/0156487 | A1 | 7/2008 | Zazovsky et al. |
| 2009/0159278 | A1 | 6/2009 | Corre et al. |
| 2009/0200016 | A1 | 8/2009 | Goodwin et al. |

(Continued)

OTHER PUBLICATIONS

International Search Report for International Application No. PCT/US2011/066070 dated Oct. 10, 2012.

(Continued)

*Primary Examiner* — Elizabeth Gitlin
(74) *Attorney, Agent, or Firm* — Michael Dae

(57) ABSTRACT

A sampling assembly of a single packer assembly may have more guard drains than sampling drains. The single packer assembly having the sampling assembly may be deployed in a wellbore formed in a subterranean formation, and the single packer assembly may be deployed on a wireline cable or another deployment or conveyance. The number and the area of the sampling drains, the number and the area of the guard drains, and the positions of the sampling drains and the guard drains may be designed so that the guard drains which are operational may provide a fluid intake rate exceeding a predetermined threshold if one of the guard drains is congested and/or blocked.

8 Claims, 7 Drawing Sheets

(56) References Cited

U.S. PATENT DOCUMENTS

2009/0301715 A1 12/2009 Corre et al.

OTHER PUBLICATIONS

Examiners Report and Examination Search Report for Canadian Application No. 2821727 dated Nov. 25, 2014.
Examiner's Report for Canadian Application No. 2821727 dated Apr. 29, 2014.
Office Action No. 42211 issued in related MX/a/2013/005744 on May 26, 2015, 10 pages.
Office Action No. 98191 issued in related MX/a/2013/005744 on Nov. 26, 2015, 7 pages.
Examination Report issued in related CA application 2821727 on Feb. 22, 2016, 9 pages.

SAMPLING ASSEMBLY FOR A SINGLE PACKER

BACKGROUND

Hydrocarbons, such as oil and natural gas, are obtained from a subterranean geologic formation by drilling a wellbore that penetrates the hydrocarbon-bearing formation. After a wellbore has been drilled, the wellbore may be "completed" before hydrocarbons are obtained.

A packer is a device having an initial outside diameter which is smaller than a wellbore in which the packer is implemented. The packer is positioned at a desired location within the wellbore. Then, a sealing element of the packer is expanded to create an increased outside diameter which forms an annular seal between the packer and a surrounding outer surface, such as a casing string or a wall of the wellbore.

The annular seal isolates the wellbore sections above the packer from the wellbore sections below the packer and may provide a mechanical anchor which prevents the packer from sliding inside the wellbore. Alternatively or additionally, the packer may have slips which are components which engage the surrounding outer surface to anchor the packer in position. Mechanically anchoring the packer is known as "setting" the packer.

A packer may be set in a cased wellbore or an uncased wellbore to create an annular seal. After a particular operation is complete, the sealing element and/or the slips may be retracted to enable the packer to be removed or moved to another location in the wellbore.

It remains desirable to provide improvements in packers and methods of setting packers.

DETAILED DESCRIPTION

The present disclosure generally relates to a sampling assembly of a single packer assembly. The sampling assembly of the single packer assembly may have more guard drains than sampling drains. The single packer assembly having the sampling assembly may be deployed in a wellbore fowled in a subterranean formation, and the single packer assembly may be deployed on a wireline cable or another deployment or conveyance. The sampling assembly may be connected to a downstream component, such as a fluid analysis module, a fluid containment module and/or the like.

Figure 1:
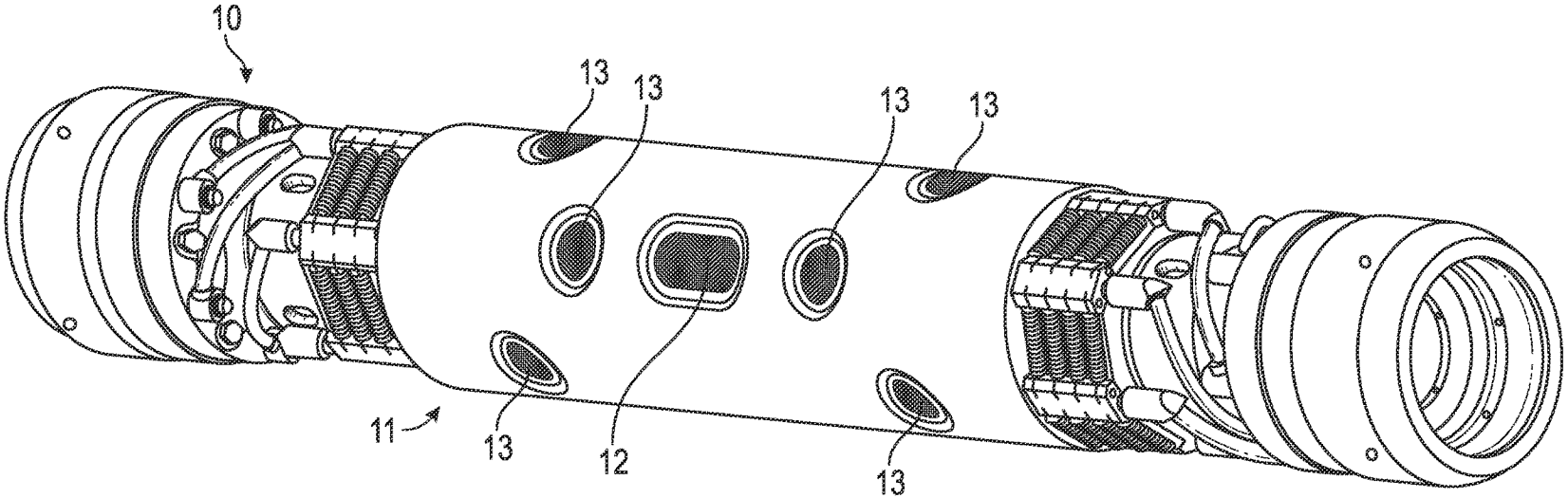
FIG. 1 illustrates an example of a packer assembly which may implement embodiments of a sampling assembly in accordance with one or more aspects of the present disclosure.
Figure 2:
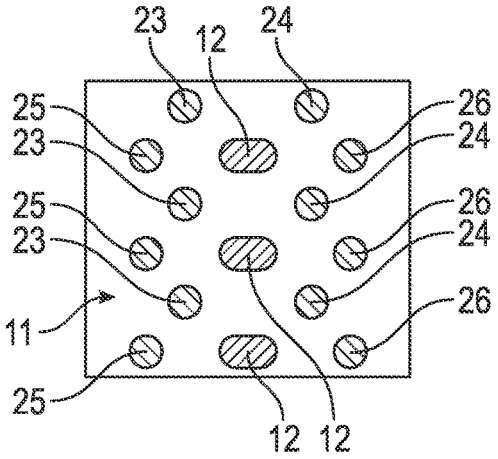
FIGS. 2-17 illustrate examples of embodiments of a sampling assembly in accordance with one or more aspects of the present disclosure.

FIGS. 1 and 2 generally illustrate an embodiment of a single packer assembly 10 having a sampling assembly 11 according to one or more aspects of the present disclosure. FIG. 2 is oriented such that the left side of FIG. 2 is the side which faces one end of the sampling assembly 11, such as the bottom end or the top end, and the right side of FIG. 2 is the side which faces the other end of the sampling assembly 11. Accordingly, left-to-right and right-to-left in FIG. 2 are axial directions, and top-to-bottom and bottom-to-top in FIG. 2 are radial directions.

The sampling assembly 11 may have sampling drains 12 and may have guard drains 13. Each of the sampling drains 12 may be connected to a sampling flowline which receives and conveys fluid obtained by one or more of the sampling drains 12 as discussed in more detail hereafter. Each of the guard drains 13 may be connected to a guard flowline which receives and conveys fluid obtained by one or more of the guard drains 13 as discussed in more detail hereafter. The sampling drains 12 may collect virgin fluid, and the guard drains 13 may collect contaminated fluid. For example, the sampling drains 12 may obtain samples of clean formation fluid from a connate fluid zone, and the guard drains 13 may draw contaminated fluid from an invaded zone into the sampling assembly 11 and away from the sampling drain 12.

Formation fluids may be collected through the sampling drains 12 and the guard drains 13 and may be conveyed to a desired collection location. In some embodiments, the single packer assembly 10 may use a single expandable sealing element which may expand across an expansion zone of the wellbore. The formation fluids may be collected from the middle of the expansion zone, namely the region between the axial ends of the packer assembly 10.

FIGS. 2-5 generally illustrate embodiments of the packer assembly 10 for which the sampling assembly 11 may have three of the sampling drains 12 and twelve of the guard drains 13. Such an embodiment may be referred to as a "6-3-6" packer with the first number and the last number indicating the number of guard drains and the middle number indicating the number of sampling drains.

FIGS. 2-5 are oriented such that the left side of FIGS. 2-5 is the side which faces one end of the sampling assembly 11, such as the bottom end or the top end, and the right side of FIGS. 2-5 is the side which faces the other end of the sampling assembly 11. Accordingly, left-to-right and right-to-left in FIGS. 2-5 are axial directions, and top-to-bottom and bottom-to-top in FIGS. 2-5 are radial directions.

Each of the sampling drains 12 may have six of the guard drains 13 positioned proximately to the sampling drain 12. For example, a first inner set 23 of the guard drains 13 may be positioned co-linear radially relative to each other and/or may be positioned at the same axial distance. The first inner set 23 of the guard drains 13 may be positioned parallel to the sampling drains 12. A second inner set 24 of the guard drains 13 may be positioned co-linear radially relative to each other and/or at the same axial distance. The second inner set 24 of the guard drains 13 may be positioned parallel relative to the sampling drains 12 and/or the first set 23 of the guard drains 13. The first inner set 23 of the guard drains 13 may be positioned on an opposite side of the sampling drains 12 relative to the second inner set 24 of the guard drains 13.

A first outer set 25 of the guard drains 13 may be positioned co-linear radially relative to each other and/or may be positioned at the same axial distance. The first outer set 25 of the guard drains 13 may be positioned parallel relative to the sampling drains 12, the first inner set 23 of the guard drains 13, and/or the second inner set 24 of the guard drains 13. A second outer set 26 of the guard drains 13 may be positioned co-linear radially relative to each other and/or may be positioned at the same axial distance. The second outer set 26 of the guard drains 13 may be positioned parallel to the sampling drains 12, the first inner set 23 of the guard drains 13, the second inner set 24 of the guard drains 13, and/or the first outer set 25 of the guard drains 13. The first inner set 23 of the guard drains 13 may be located between the sampling drains 12 and the first outer set 25 of the guard drains 13. The second inner set 24 of the guard drains 13 may be located between the sampling drains 12 and the second outer set 26 of the guard drains 13.

Figure 3:
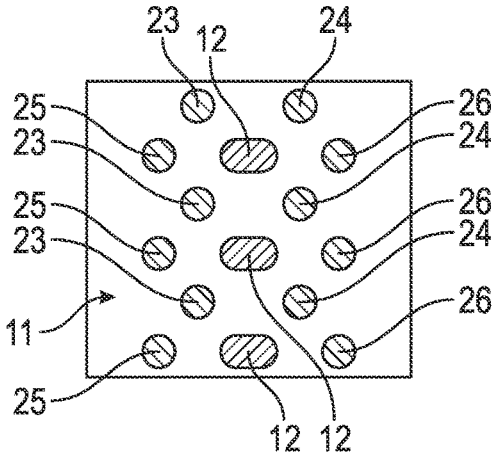
Figure 4:
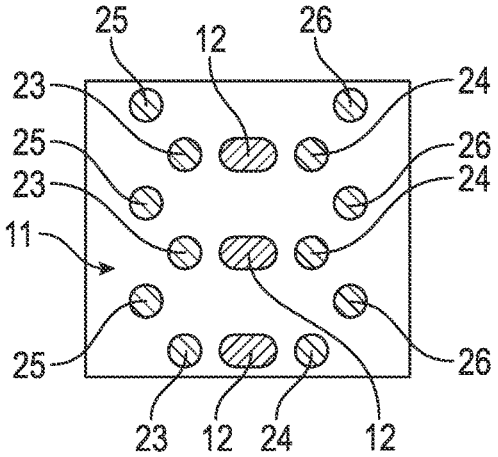
Figure 5:
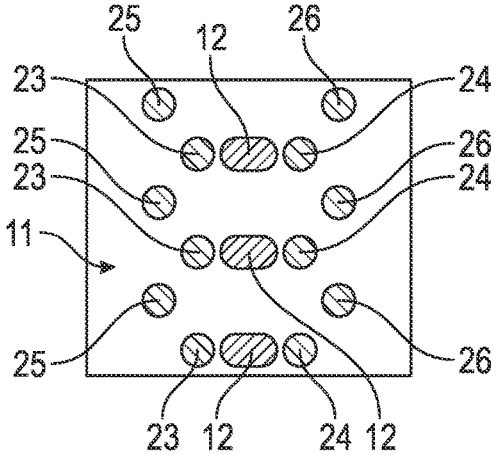
Figure 6:
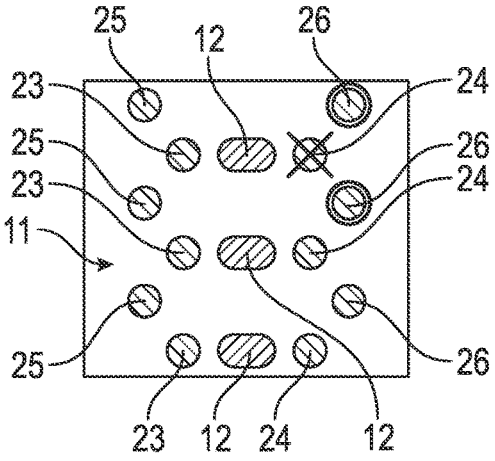
Figure 7:
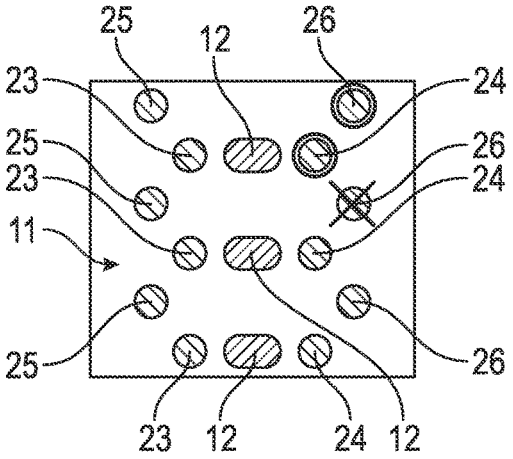
Figure 8:
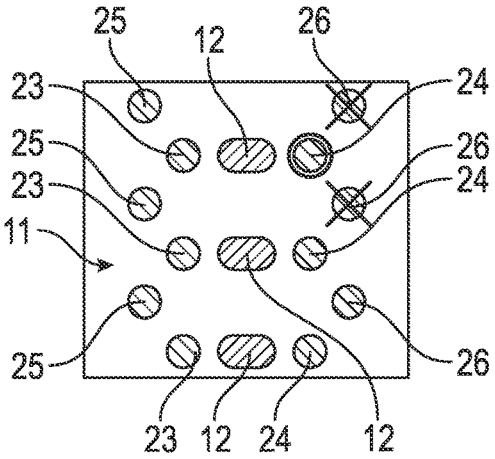
Figure 9:
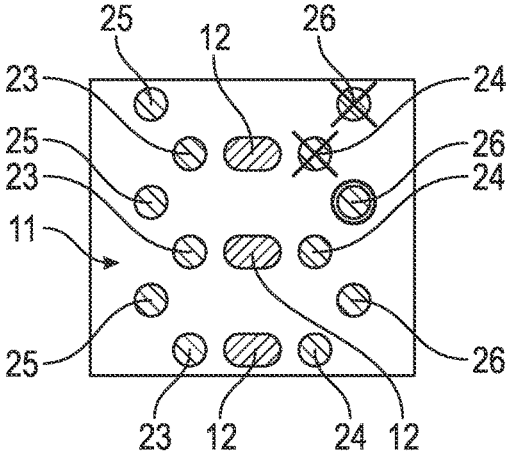

FIGS. 2 and 4 generally illustrate embodiments of the sampling assembly 11 for which the first outer set 25 of the guard drains 13 and the second outer set 26 of the guard drains 13 may be axially aligned with the sampling drains 12. The first inner set 23 of the guard drains 13 and the second inner set 24 of the guard drains 13 may be axially un-aligned with the sampling drains 12. FIGS. 3 and 5 generally illustrate embodiments of the sampling assembly 11 in which the first inner set 23 of the guard drains 13 and the second inner set 24 of the guard drains 13 may be axially aligned with the sampling drains 12. The first outer set 25 of the guard drains 13 and the second outer set 26 of the guard drains 13 may be axially un-aligned with the sampling drains 12.

As generally illustrated in FIGS. 1-5, the area of each of the sampling drains 12 may be a different size relative to the area of each of the guard drains 13. In an embodiment where the sampling drains 12 and the guard drains 13 are substantially circular, the area of each of the sampling drains 12, namely pi multiplied by the radius of each of the sampling drains 12 to the second power, may be a different size relative to the area of each of the guard drains 13, namely pi multiplied by the radius of each of the guard drains 13 to the second power. In an embodiment, one or more of the sampling drains 12 and/or one or more of the guard drains 13 may be substantially oval; however, the present invention is not limited to a specific shape of the sampling drains 12 and the guard drains 13.

In an embodiment, each of the sampling drains 12 may have a area which is approximately twice as large as the area of each of the guard drains 13. The number and the area of the sampling drains 12 and the number and the area of the guard drains 13 may be varied based on properties of the wellbore and/or properties of the formation surrounding the wellbore. The area of each the sampling drains 12 may be the approximately same size relative to the area of each of the guard drains 13, and the sampling drains 12 and the guard drains 13 are not limited to a specific size or relative size.

For example, as generally illustrated in FIGS. 6-9, one or more of the guard drains 13 may be congested and/or blocked, as shown with an "X" thereon. However, one or more adjacent ones of the guard drains 13 may be operational, as shown with a circle. The sampling assembly 11 of the single packer assembly 10 may be designed so that the guard drains 13 which are operational may provide a fluid intake rate exceeding a predetermined threshold if one of the guard drains 13 is congested and/or blocked. For example, the number and the area of the sampling drains 12, the number and the area of the guard drains 13, and the positions of the sampling drains 12 and the guard drains 13 may be designed so that the guard drains 13 which are operational may provide a fluid intake rate exceeding a predetermined threshold if one of the guard drains 13 is congested and/or blocked.

Figure 10:
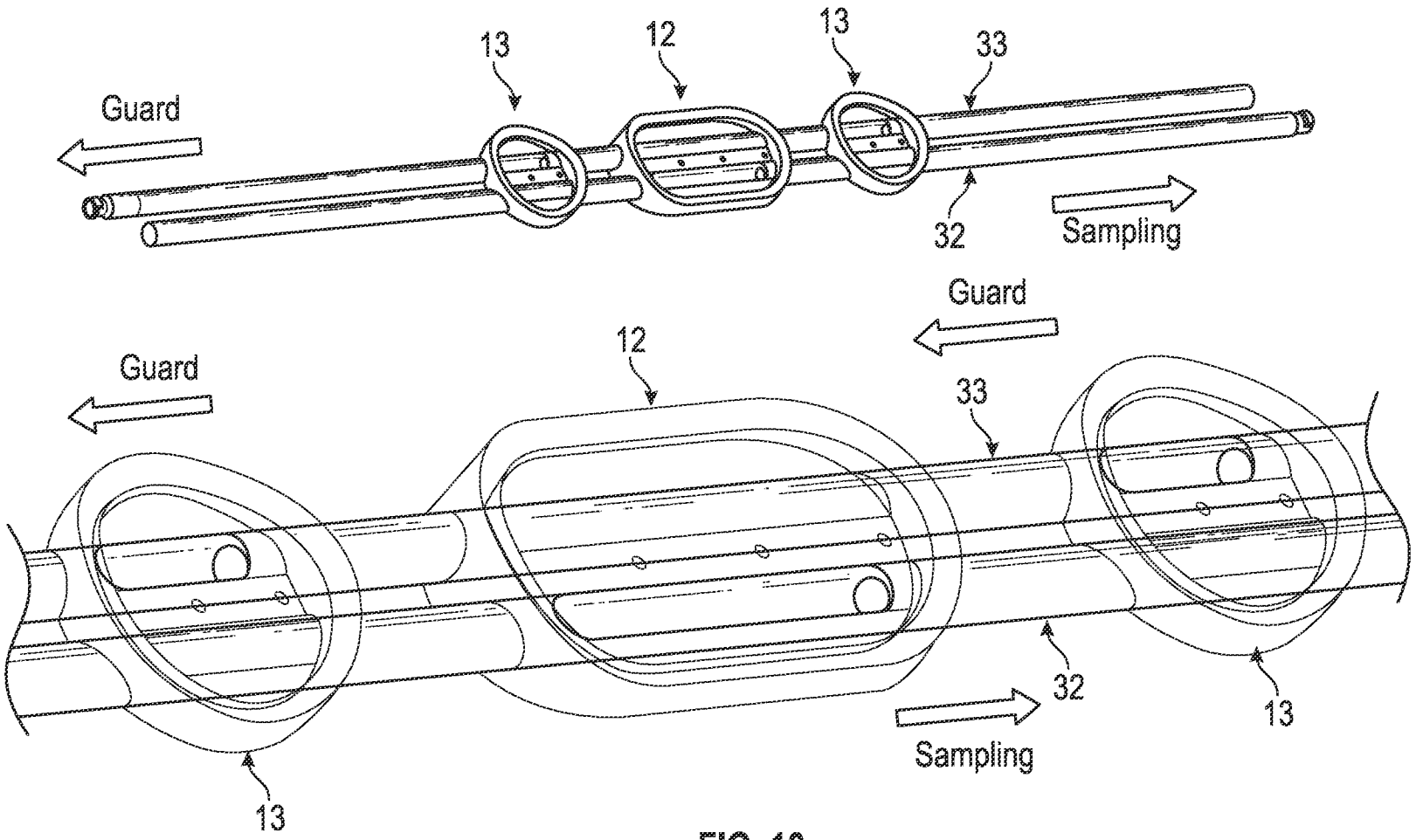

As generally illustrated in FIG. 10, the single packer assembly 10 and/or the sampling assembly 11 may have a sampling flowline 32 and a guard flowline 33. The sampling flowline 32 may be positioned adjacent to and/or parallel to the guard flowline 33. In an embodiment, the sampling flowline 32 and the guard flowline 33 may be in fluid communication with the sampling drains 12 and the guard drains 13 which are aligned with the sampling drains 12. For example, the sampling flowline 32 and the guard flowline 33 may be positioned in, adjacent to and/or directly under the sampling drains 12 and the guard drains 13 which are aligned with the sampling drains 12.

As generally illustrated in FIG. 10, the sampling flowline 32 may have an aperture positioned in each of the sampling drains 12, and fluids entering the sampling drains 12 may enter the sampling flowline 32 through these apertures. The guard flowline 33 may have apertures positioned in the guard drains 13, and fluids entering the guard drains 13 may enter the guard flowline 33 through these apertures.

FIGS. 11-15 generally illustrate various embodiments of the sampling assembly 11 of the single packer assembly 10. FIGS. 11-15 are oriented such that the left side of FIGS. 11-15 is the side which faces one end of the sampling assembly 11, such as the bottom end or the top end, and the right side of FIGS. 11-15 is the side which faces the other end of the sampling assembly 11. Accordingly, left-to-right and right-to-left in FIGS. 11-15 are axial directions, and top-to-bottom and bottom-to-top in FIGS. 11-15 are radial directions.

Figure 11:
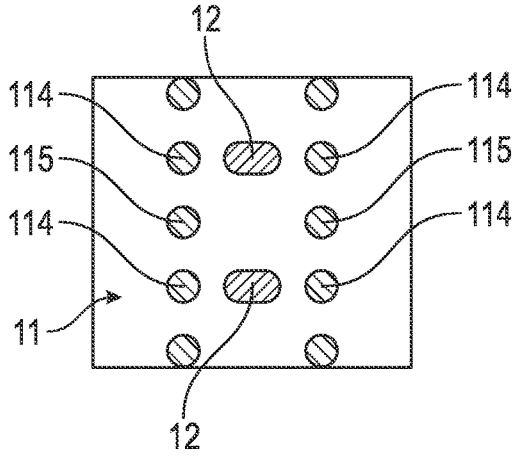

FIG. 11 generally illustrates an embodiment of the sampling assembly 11 having a 4-2-4 configuration. Aligned guard drains 114 may be axially aligned with one or more of the sampling drains 12. Unaligned guard drains 115 may be not axially aligned with any of the sampling drains 12. Each of the sampling drains 12 may be located between two aligned guard drains 114 of the guard drains 13, and one of the unaligned guard drains 115 may be located between each pair of the aligned guard drains 114. Each of the aligned guard drains 114 may be positioned at the same axial distance; each of the unaligned guard drains 115 may be positioned at the same axial distance; and, in an embodiment, the aligned guard drains 114 may be positioned at the same axial distance as the unaligned guard drains 115.

The aligned guard drains 114 and the unaligned guard drains 115 on one side of the sampling drains 12 may be co-linear radially relative to each other, and the aligned guard drains 114 and the unaligned guard drains 115 on the other side of the sampling drains 12 may be co-linear radially relative to each other. Each of the sampling drains 12 may have a area which is approximately twice as large as the area of each of the guard drains 13.

Figure 12:
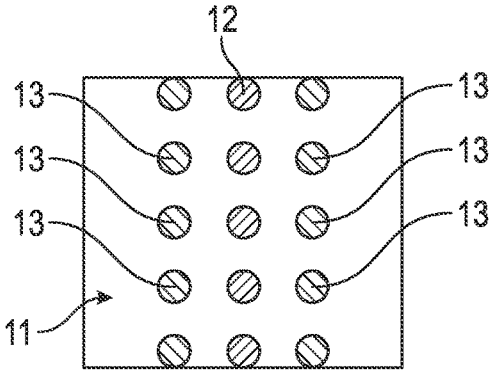

FIG. 12 generally illustrates an embodiment of the sampling assembly 11 having a 4-4-4 configuration. Each of the guard drains 13 may be axially aligned with one of the sampling drains 12. Each of the sampling drains 12 may be located between two of the guard drains 13. Each of the guard drains 13 on one side of the sampling drains 12 may be positioned at the same axial distance, and each of the guard drains 13 on the other side of the sampling drains 12 may be positioned at the same axial distance. The guard drains 13 on one side of the sampling drains 12 may be co-linear radially relative to each other, and the guard drains 13 on the other side of the sampling drains 12 may be co-linear radially relative to each other.

The guard drains 13 on one side of the sampling drains 12 may be parallel to the sampling drains 12, and the guard drains 13 on the other side of the sampling drains 12 may be parallel relative to the sampling drains. Each of the sampling drains 12 may have a area which is approximately the same as the area of each of the guard drains 13.

Figure 13:
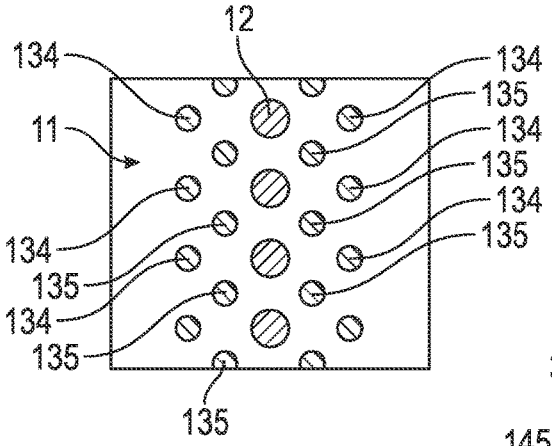

FIG. 13 generally illustrates an embodiment of the drain assembly 11 having a 4-2-4 configuration. Each of the sampling drains 12 may have a area which is approximately twice as large as the area of each of the guard drains 13. Aligned guard drains 134 may be axially aligned with one or more of the sampling drains 12. Unaligned guard drains 135 may be not axially aligned with any of the sampling drains 12. Each of the sampling drains 12 may be located between two of the aligned guard drains 134, and one of the unaligned guard drains 135 may be located between each pair of the aligned guard drains 134.

Each of the aligned guard drains 134 on one side of the sampling drains 12 may be positioned at the same axial distance, and each of the aligned guard drains 134 on the other side of the sampling drains 12 may be positioned at the same axial distance. Each of the unaligned guard drains 135 on one side of the sampling drains 12 may be positioned at the same axial distance, and each of the unaligned guard drains 135 on the other side of the sampling drains 12 may be positioned at the same axial distance.

The aligned guard drains 134 on one side of the sampling drains 12 may be co-linear radially relative to each other, and the aligned guard drains 134 on the other side of the sampling drains 12 may be co-linear radially relative to each other. The unaligned guard drains 135 on one side of the sampling drains 12 may be co-linear radially relative to each other, and the unaligned guard drains 135 on the other side of the sampling drains 12 may be co-linear radially relative to each other.

The aligned guard drains 134 on one side of the sampling drains 12 may not be co-linear radially relative to the unaligned guard drains 135 on that side of the sampling drains 12. The aligned guard drains 134 on the other side of the sampling drains 12 may be not be co-linear radially relative to the unaligned guard drains 135 on that side of the sampling drains 12.

Figure 14:
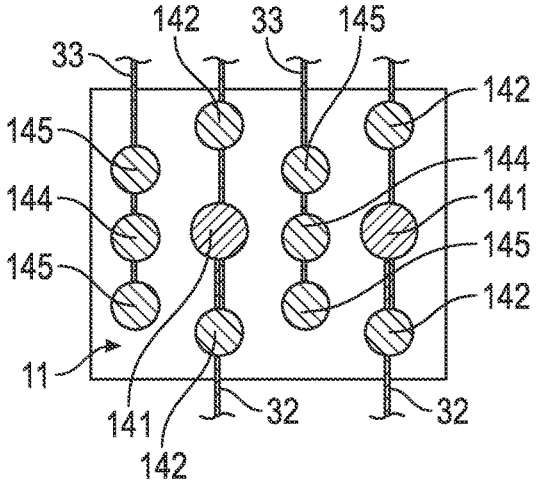

FIG. 14 generally illustrates an embodiment of the sampling assembly 11 having a 5-2-5 configuration. Aligned sampling drains 141 may be axially aligned with two or more of guard drains 144, 145. Unaligned sampling drains 142 may be not axially aligned with any of the guard drains 144, 145. Aligned guard drains 144 may be axially aligned with one or more of the aligned sampling drains 142. Unaligned guard drains 145 may be not axially aligned with any of the sampling drains 12. For example, each of the aligned sampling drains 141 may be located between two of the aligned guard drains 144.

The guard drains 144, 145 on one side of the sampling drains 141, 142 may be co-linear radially relative to each other, and the guard drains 144, 145 on the other side of the sampling drains 141, 142 may be co-linear radially relative to each other. Each of the guard drains 144, 145 on one side of the sampling drains 141, 142 may be positioned at the same axial distance, and each of the guard drains 144, 145 on the other side of the sampling drains 141, 142 may be positioned at the same axial distance.

Figure 15:
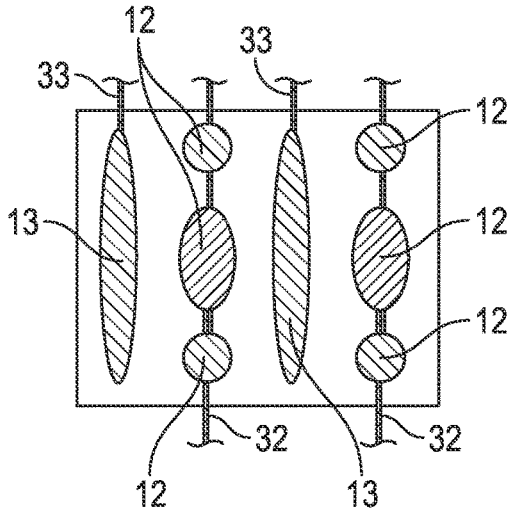

FIG. 15 generally illustrates an embodiment of the sampling assembly 11 having a 3-2-3 configuration. The guard drains 13 may have an oval shape. Three of the sampling drains 12 may be located between two of the guard drains 13 so that each of the guard drains 13 extends from the first one of the sampling drains 12 to the third one of the sampling drains 12. In an embodiment, the middle one of the sampling drains 12 may have an oval shape with a shorter length than each of the guard drains 13; however, the guard drains 13 and the sampling drains 12 may be any shape or size.

Other drain configurations may be designed to optimize packer efficiency, depending on the design requirements of the single packer assembly 10 or the like. A multitude of configurations having more or less of the sample drains 12, more or less of the guard drains 13, and/or different configurations of the sample drains 12 and the guard drains 13 may be disposed in the single packer assembly 10 as required by the size of the single packer assembly 10 and its design requirements.

Figure 16:
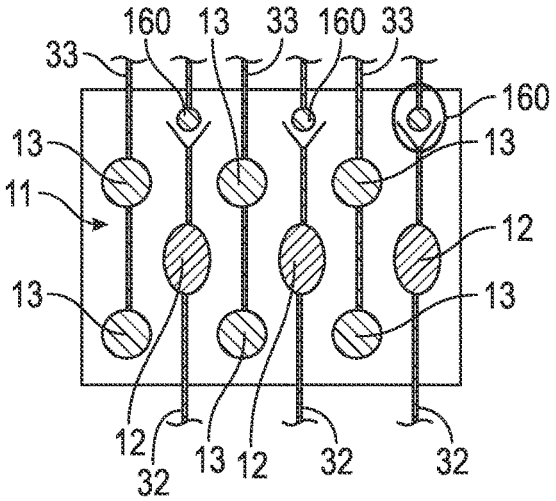
Figure 17:
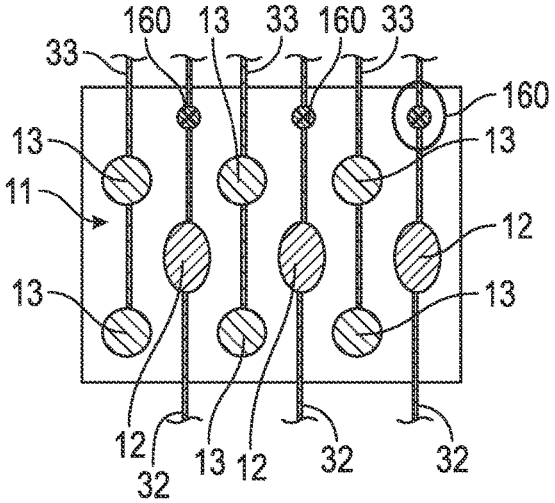

In an embodiment, the sampling flowline 33 may be connected to a guard circuit which is in fluid communication with the guard drains 13. In such an embodiment, fluid from a sampling area may be cleaned through the guard circuit by activating a guard pump that is at least a portion of the guard circuit. If a sampling pump is activated, the sampling flowline 33 may be isolated from the guard circuit by valves 160. One or more of the valves 160 may be self-actuated as generally illustrated in FIG. 16, such as by pressure equalization when the sampling pump is activated. One or more of the valves 160 may be actuated by an operator as generally illustrated in FIG. 17. In an embodiment, the guard drains 13 may be in fluid communication with a guard circuit and the sampling drains 12 may be in fluid communication with a sampling circuit.

FIGS. 16 and 17 are oriented such that the left side of FIGS. 16 and 17 is the side which faces one end of the sampling assembly 11, such as the bottom end or the top end, and the right side of FIGS. 16 and 17 is the side which faces the other end of the sampling assembly 11. Accordingly, left-to-right and right-to-left in FIGS. 16 and 17 are axial directions, and top-to-bottom and bottom-to-top in FIGS. 11-15 are radial directions.

Figure 18:
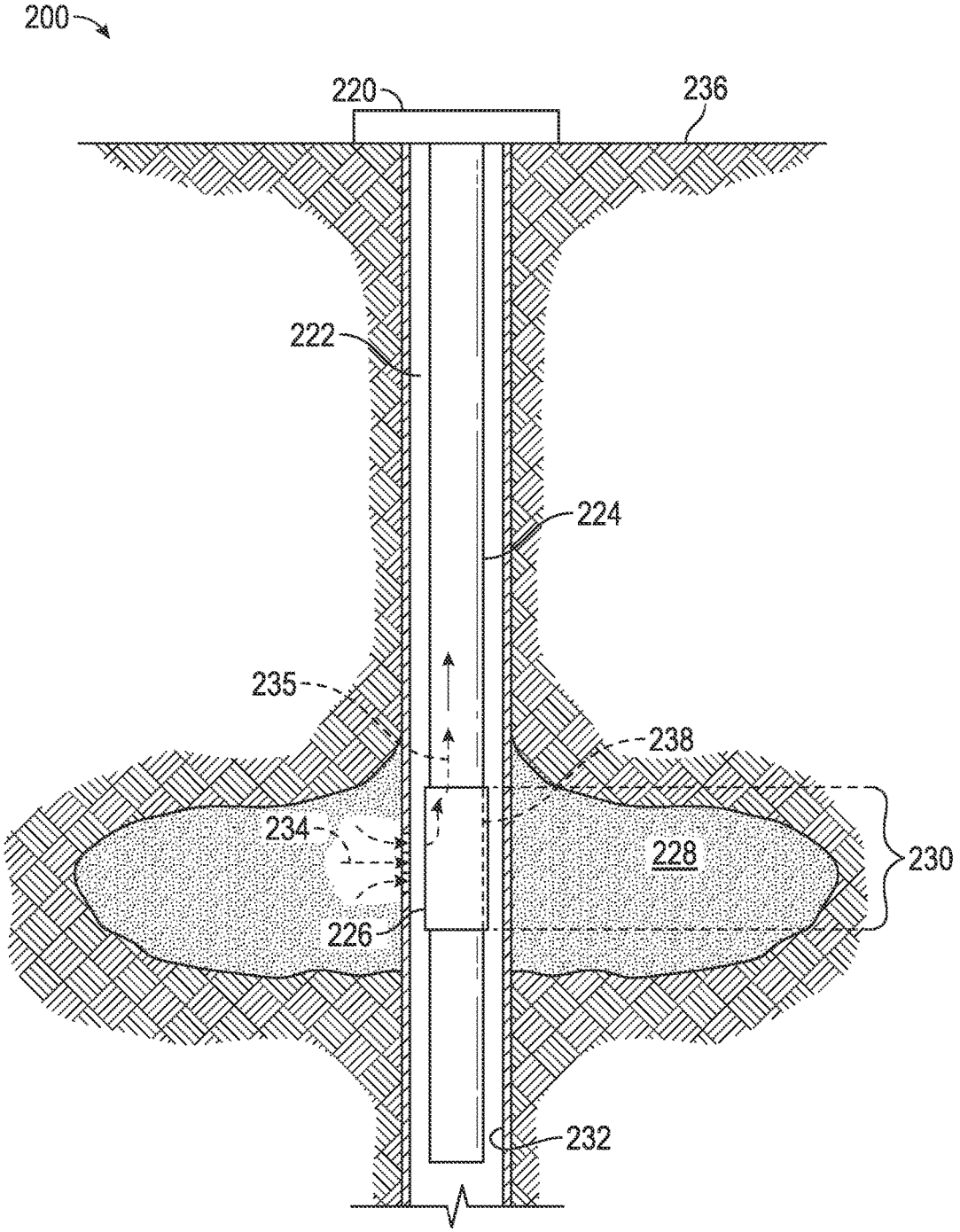
FIG. 18 illustrates an example of a wellbore system in which embodiments of a packer assembly having a sampling assembly may be employed in accordance with one or more aspects of the present disclosure.

FIG. 18 generally illustrates an embodiment of a well system 200. The well system 200 may have a conveyance 224 employed for delivery into a wellbore 222 of at least one packer assembly 226, such as the single packer assembly 10 and/or another type of packer assembly. The conveyance 224 may be a wireline, a tubing string, and/or the like. The packer assembly 226 may collect formation fluids from a surrounding formation 228. The packer assembly 226 may be positioned in the wellbore 222 and then may be expanded in a radially outward direction to seal across an expansion zone 230 with a surrounding wellbore wall 232, such as a surrounding casing or open wellbore wall. When the packer assembly 226 is expanded to seal against the surrounding wellbore wall 232, formation fluids may be obtained by the packer assembly 226 as indicated by arrows 234. The formation fluids obtained by the packer assembly 226 may be directed to a flow line 235 and may be carried to a collection location, such as a location at a well site surface 236. A viscosity lowering system 238 may be incorporated into the packer assembly 226 to enable selective lowering of the viscosity of a substance, such as oil, to be sampled through the packer assembly 226.

The preceding description has been presented with reference to present embodiments. Persons skilled in the art and technology to which this disclosure pertains will appreciate that alterations and changes in the described structures and methods of operation can be practiced without meaningfully departing from the principle and scope of the disclosure. Accordingly, the foregoing description should not be read as pertaining only to the precise structures described and shown in the accompanying drawings, but rather should be read as consistent with and as support for the following claims, which are to have their fullest and fairest scope.

Moreover, means-plus-function clauses in the claims cover the structures described herein as performing the recited function and not only structural equivalents but also equivalent structures. Thus, a nail and a screw may not be structural equivalents because a nail employs a cylindrical surface to secure parts together and a screw employs a helical surface, but in the environment of fastening parts, a nail may be the equivalent structure to a screw. Applicant expressly intends to not invoke 35 U.S.C. §112, paragraph 6, for any of the limitations of the claims herein except for claims which explicitly use the words "means for" with a function.

We claim:

1. An expandable packer assembly comprising:

a sampling assembly having guard drains positioned adjacent to a first sampling drain wherein at least two of the guard drains are axially aligned with the first sampling drain, wherein the expandable packer assembly comprises a single expandable sealing element which may expand across an expansion zone of the wellbore;

a guard flowline in fluid communication with at least one of the guard drains, but not in fluid communication with the first sampling drain;

a guard aperture in each of the guard drains, the guard aperture fluidly connecting the guard flowline to the guard drains;

a sampling flowline in fluid communication with the first sampling drain, but not in fluid communication with the guard drains, wherein the sampling flowline and the guard flowline are both positioned in both the first sampling drain and the guard drains that are axially aligned with the first sampling drain, and a sampling aperture in the first sampling drain, the sampling aperture fluidly connecting the sampling flowline to the first sampling drain.

2. The expandable packer assembly of claim 1 wherein an area of the first sampling drain is approximately equal to an area of one of the two guard drains that are axially aligned with the first sampling drain.

3. The expandable packer assembly of claim 1 wherein an area of the first sampling drain is approximately twice the size of an area of one of the two guard drains that are axially aligned with the first sampling drain.

4. The expandable packer assembly of claim 1 wherein an area of one of the two guard drains that are axially aligned with the first sampling drain is approximately twice the size of an area of the first sampling drain.

5. The expandable packer assembly of claim 1 further comprising:

a second sampling drain which is out of axial alignment with any of the guard drains.

6. The expandable packer assembly of claim 1 further comprising:

a second sampling drain with which at least two additional guard drains are axially aligned.

7. The expandable packer assembly of claim 1 wherein the sampling flowline and the guard flowline are at least partially parallel with each other, both of which are located under at least one of the first sampling drain and at least one of the guard drains.

8. The expandable packer assembly of claim 1 further comprising:

a tool string for which the expandable packer assembly comprises at least a portion.

* * * * *